United States Patent [19]

Vaillant et al.

[11] 4,227,676

[45] Oct. 14, 1980

[54] VEHICLE UNLOADING MACHINE

[75] Inventors: Christian Vaillant; Eugenè Korcz, both of Douchy les Mines, France

[73] Assignee: Fives-Cail Babcock, Paris, France

[21] Appl. No.: 8,744

[22] Filed: Feb. 1, 1979

[30] Foreign Application Priority Data

Feb. 6, 1978 [FR] France ..... 78 03173

[51] Int. Cl.[3] ..... B66C 23/60; B66D 1/44

[52] U.S. Cl. ..... 254/277; 212/148

[58] Field of Search ..... 254/139-146, 254/172, 173; 414/625; 212/58 A; 175/5, 27; 173/151

[56] References Cited

U.S. PATENT DOCUMENTS

| | | | |
|---|---|---|---|
| 3,172,485 | 3/1965 | Spannhake et al. | 254/172 X |
| 3,378,158 | 4/1968 | Lopez | 254/172 X |
| 3,789,932 | 2/1974 | Giroux | 414/625 X |
| 3,894,582 | 7/1975 | Kammerer | 175/5 X |

*Primary Examiner*—John M. Jillions

*Attorney, Agent, or Firm*—Kurt Kelman

[57] ABSTRACT

A vehicle unloader particularly adapted for unloading trucks and trailers used to transport sugar cane, which comprises a sloping jib, a lifting mechanism consisting of a motor, a pulley mounted at one end of the jib, a first cable passing over the pulley and attached to a hook, and a hook positioning system consisting of a second cable attached to the hook and the jib, a cylinder for varying the tension of the second cable, a three-position selector having a first position causing the cylinder to move so that the hook is brought towards the jib, a second position causing the cylinder to move so that the hook is allowed to move in the opposite direction away from the jib and a third position causing the cylinder to be isolated; a power source; and a control unit the operation of which is dependent on the amount of power absorbed by the motor of the lifting mechanism and which connects the cylinder to the power source and ensures that it is supplied with reduced power from the source when the hook is loaded and the motor is energized.

7 Claims, 4 Drawing Figures

VEHICLE UNLOADING MACHINE

The subject of this invention is a machine for unloading vehicles equipped with dumping bodies or with nets, which machine is made up essentially of:

- a sloping jib, below which the vehicles come to be unloaded,
- a lifting mechanism made up of:
- a winch or a similar piece of equipment,
- a cable which passes over a pulley mounted on the upper end of the jib and which is attached to a lifting-beam fitted with hooks, the purpose of which is to grip the free edge of the vehicle dumping body or that of the net, the upward movement of the hooks causing the body to tip or the net to be pulled out whereby the material contained in the body or the net is thus dumped out to the side, and
- a hook positioning system which enables the hooks to be positioned under the side of the dumping body or the net without direct manual intervention.

In an existing machine of this type, the hook positioning system consists of a cable placed on the front of the jib, the two ends being anchored to the upper and lower parts of the jib respectively. One of these anchoring points is movable, by means of a cylinder, thus enabling the cable tension and the distance from the cable to the jib to be adjusted. The hooks are attached to the cable in such a way as to allow each hook to move along the cable.

During the unloading of the material, the path followed by the hook is different from that which would be imposed on it by the positioning system, if it were not hooked to the load. The result is, that, on certain sections of the path the cable is relaxed, while on other sections it can be subjected to considerable tensile stress and can interfere with the unloading if the operator neglects to put the positioning system cylinder in the discharge position after the load has been hooked up.

The aim of this invention is to perfect this system in such a manner as to maintain constant the tension of the cable while, however, allowing the hook to follow the path imposed on it by the load. The cable can thus reduce the swinging motion of the hook and the load and assume a stabilizing role.

The unloading machine which is the subject of this invention is characterized by the fact that the lifting mechanism includes a motor, that the cylinder of the hook positioning system is operated by a three-position selector:

- a first position causing the cylinder to be moved so that the hook is brought towards the jib,
- a second position causing the cylinder to be moved so that the hook is permitted to move away from the jib,
- a third position blocking the cylinder, and that a control unit, the operation of which is dependent on the power absorbed by the motor of the lifting mechanism, releases the cylinder and ensures its supply at reduced power when the hook is loaded and the motor fed to keep taut the cable of the hook positioning system.

When the lifting mechanism includes a hydraulic motor, a hydraulic cylinder controlled by a three-step distributor is used in the hook positioning system. The first step will ensure the supply to the cylinder by a pump so that the hook is moved towards the jib, the second step will put the cylinder in the discharge position and thus allow the hook to move in the opposite direction, the third step will isolate the cylinder, and a valve, controlled by the pressure in the feed pipe to the motor of the lifting mechanism, will connect the cylinder to a source of low pressure liquid when the hook is loaded and the motor fed. This valve can, for example, be placed on a pipe which links the cylinder to the discharge tank, via a pre-adjusted valve, and onto which a pump is connected between the first valve and the pre-adjusted valve.

Usually, in this type of machine, a hook positioning cable is provided at each end of the lifting-beam. In this case each cylinder, used to adjust the tension of the cables, can be operated separately by a mechanism according to the invention.

Another characteristic of this invention is that each hook positioning cable passes over two pulleys mounted on the two ends of the jib and the two ends of the cable are fixed on the lifting-beam so as to form a loop, one of the pulleys being mobile along the jib by means of a cylinder.

It is preferable for the lifting mechanism to include a motor-driven winch and two cables attached to the two ends of the lifting-beam. This arrangement ensures that the lifting-beam is horizontally stable.

To allow the hooks to move vertically, it is advantageous to fix them onto a cross-bar which is hinged at its middle point onto the lifting-beam.

The following description refers to the accompanying drawings which show one of the many possible ways in which the invention can be constructed.

Figure 1:
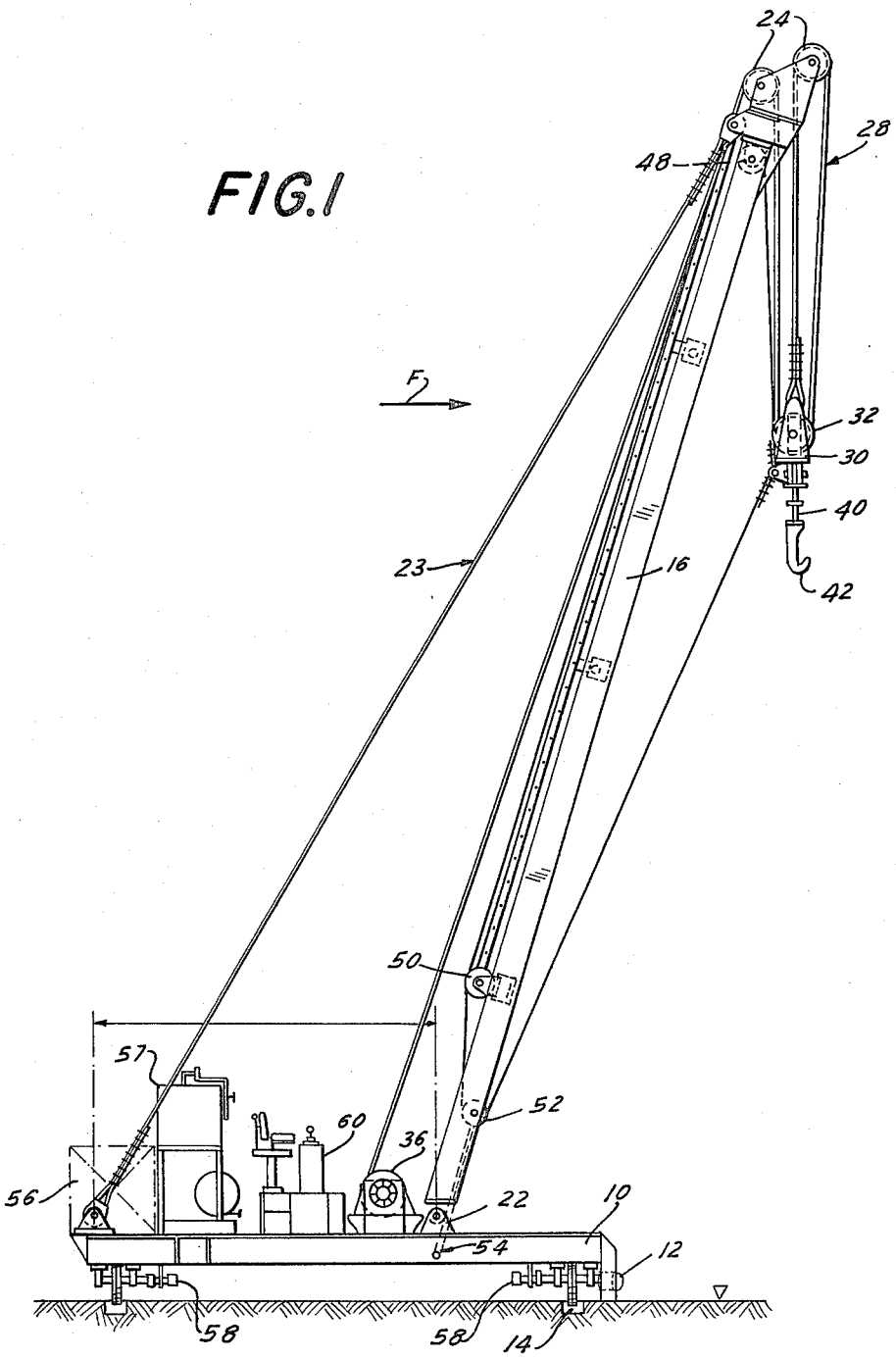
FIG. 1 is a side view of an unloading machine according to the invention.
Figure 2:
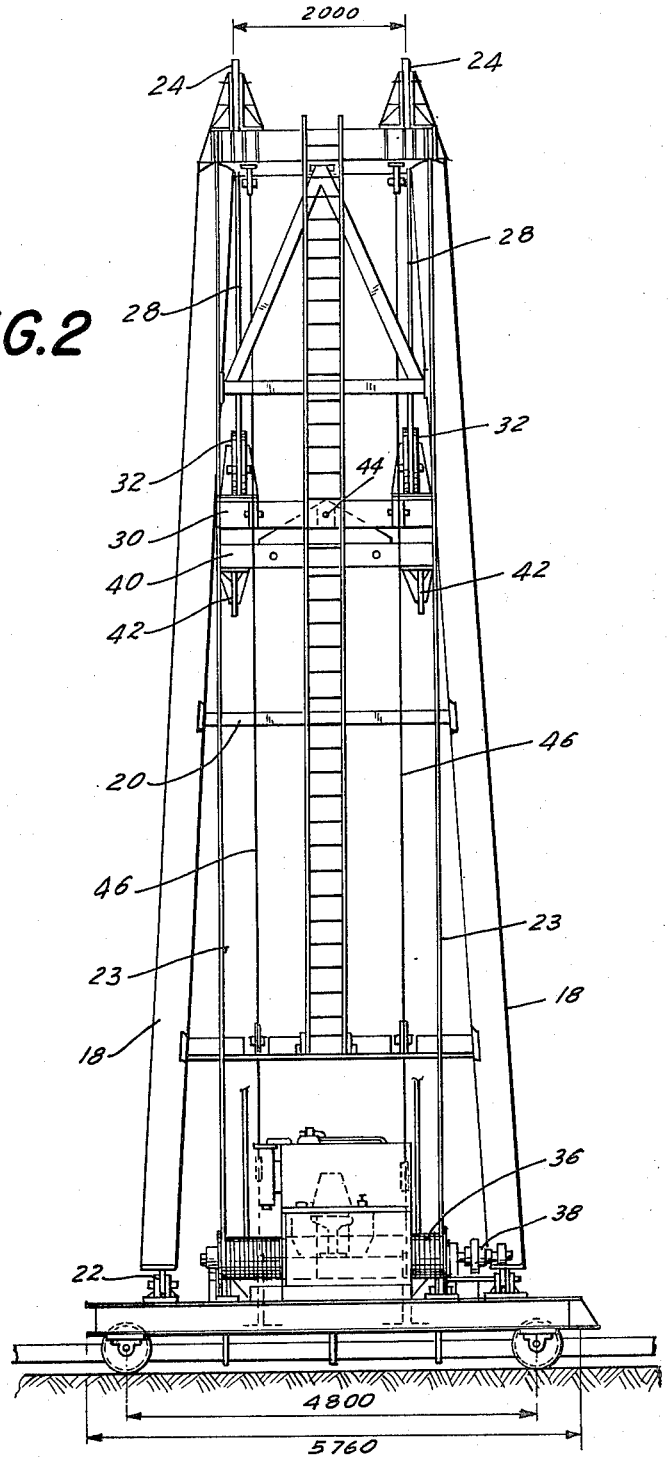
FIG. 2 is a view in the direction indicated by the arrow in FIG. 1.

The machine shown on the drawings contains a frame 10 mounted on wheels 12 which roll on rails 14. The frame supports a jib 16 made up of two columns 18 linked by cross-bars 20. The jib is hinged at its base on the frame 10, by means of axles 22 and is held at a predetermined slope by two tie-rods 23 which attach the top of the jib to the frame.

At the top of the jib are two pairs of pulleys 24 over which pass two cables 28 supporting a lifting-beam 30. Each cable is fixed to one end of the lifting-beam, passes over one of the pulleys 24, over a pulley 32 mounted on the lifting-beam, over the second pulley 24 of the same pair and is then wound around the drum of a winch 36 supported by the frame 10; this winch is driven by a hydraulic motor 38.

A cross-bar 40 bearing two or more hooks 42 is hinged on the lifting-beam 30 by means of an axle 44.

Each end of the lifting-beam 30 is attached to a cable 46 which forms a closed loop and passes over:

- an upper pulley 48 fixed to the jib
- an intermediate pulley 50 also fixed to the jib
- a lower pulley 52 mounted on the end of the rod of a cylinder 54 hinged on the frame 10. Both ends of the cables 46 are fixed to the lifting-beam.

The frame 10 also supports a counterweight 56, a hydraulic unit 57 feeding the motor 38, the cylinders 54 and the motors 58 driving the wheels 12, and a control desk 60.

Figure 3:
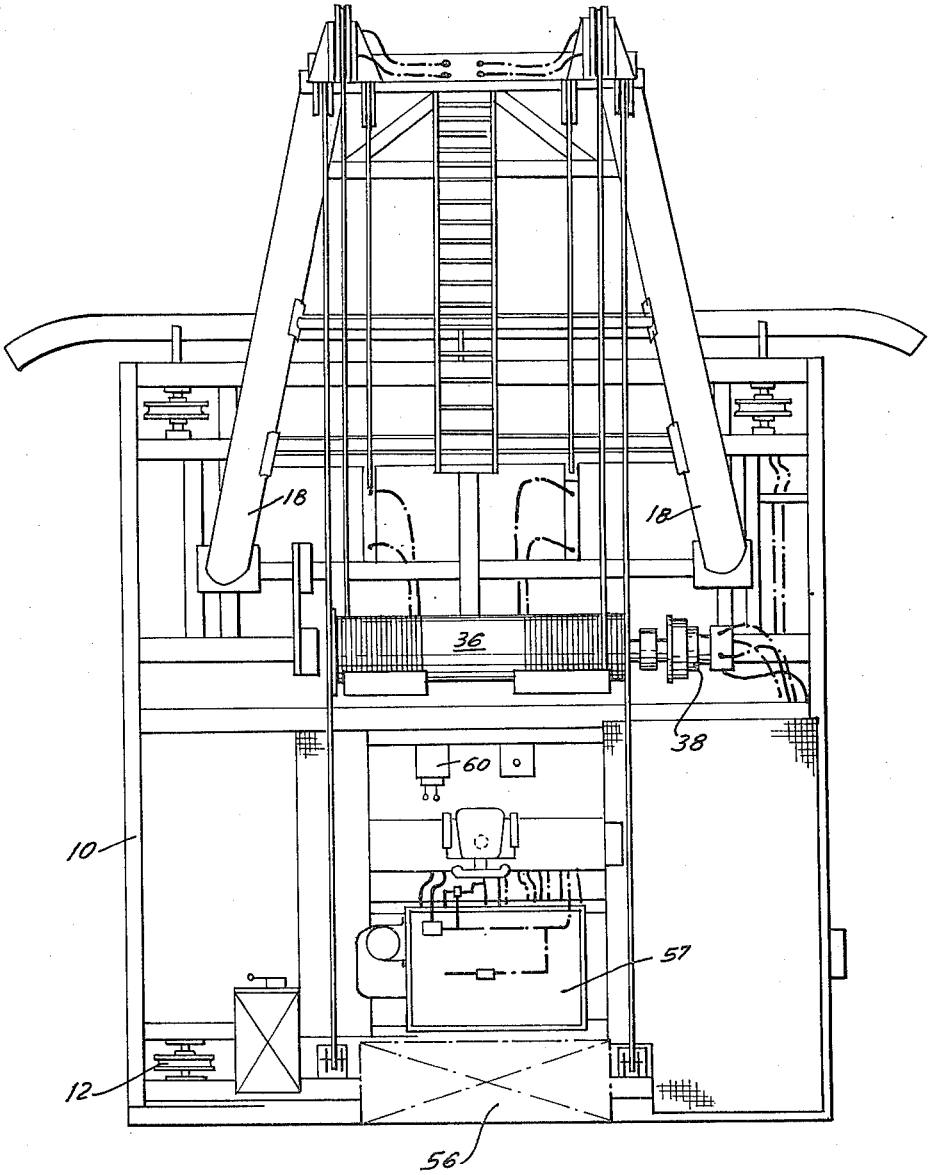
FIG. 3 is a top view of the whole machine.
Figure 4:
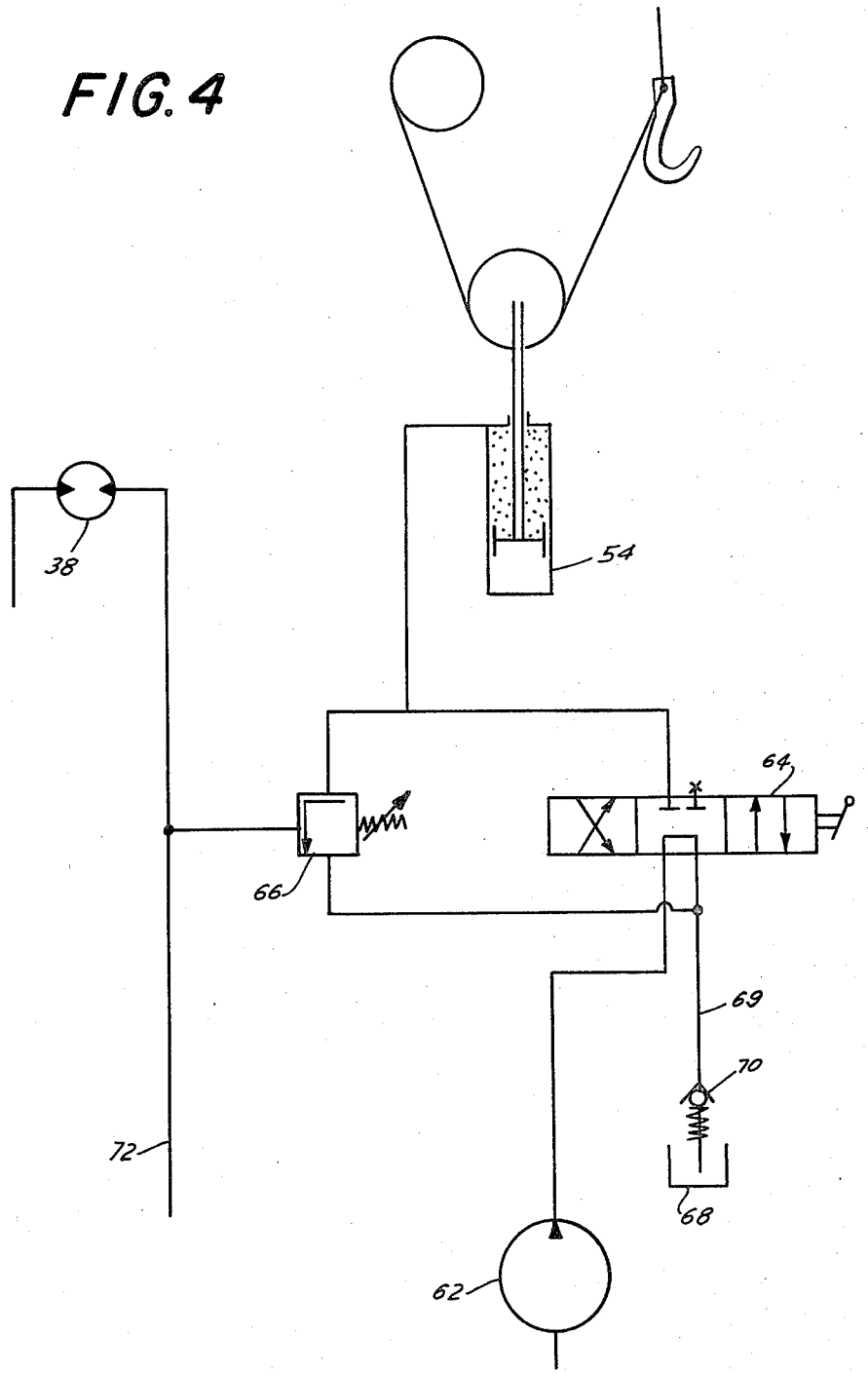
FIG. 4 is the diagrammatic representation of a part of the hydraulic system of the machine.

FIG. 4 shows the hydraulic control system of a cylinder 54. It is made up essentially of a pump 62, a three-step distributor 64 and a valve 66. The distributor 64 has three openings which are connected respectively to the cylinder 54 the discharge opening of the pump 62 the tank 68 by a pipe 69 on which is placed a pre-adjusted valve (70). When the slide-valve of the distributor is in the central or neutral position, as represented in FIG. 3, the pump is connected to the tank via the pre-adjusted valve (70) which ensures that a pressure of about 3 bars is maintained in the pipe 69, and the cylinder 54 is isolated. When the distributor slide-valve is moved to the left, the pump 62 supplies power to the cylinder 54 and the pulley 52 is brought downwards, pulling the cable 46 and thus bringing the lifting-beam 30 towards the jib. When the distributor slide-valve is moved to the right of its central position, the cylinder 54 is connected to the tank and the pulley 52 can move upwards, drawn by the cable 46. The setting of the pre-adjusted valve 70 is chosen so that this movement can be actuated by the weight of the lifting-beam without its load.

The valve 66 is operated by the pressure inside the feed pipe of the lifting motor 38; it remains closed so long as this pressure is lower than a predetermined value chosen so that the valve only opens when a load is placed on the hooks 42. This valve is on a pipe connecting the cylinder 54 to the pipe 69 above the pre-adjusted valve 70.

Both cylinders 54 are provided with this system and they can be operated separately or simultaneously.

To unload a vehicle which is placed under the jib, it is first of all necessary to position the hooks 42 in such a manner that they grip the side of the dumping body or the bar fixed to the free edge of the net. To do so, the lifting-beam 30 is brought down by means of the winch 36 so as to bring the hooks below the level of the edge of the dumping body of the bar. The hooks are then moved beneath the edge of the body or the bar by operating the distributors 64 and the lifting-beam is lifted so that the hooks catch on to the load. As this lifting movement takes place without a load, the pressure in the pipe 72 is not sufficient to activate the valves 66 and the oil contained in the cylinders cannot therefore escape, thus enabling the hooks to follow the path imposed on them by the cables 46.

While the load is being lifted, the pressure in the pipe 72 is sufficient to open the valves 66 which connect the cylinder 54 to the pumps 62 which discharge at a pressure fixed by the pre-adjusted valves 70.

This characteristic allows the hooks to follow the path imposed on them by the load which is usually different from the elliptical path imposed by the cables when the pulleys 52 are kept in one position, while at the same time keeping the tension of the cables 46 constant throughout the lifting operation.

If the pulleys 52 are pulled upwards, the oil in the cylinders 54 escapes to the tank through the valves 66 and the pre-adjusted valves 70. If the tension of the cables 46 is reduced when the hooks are moved towards the jib, the pumps 62 supply power to the cylinders 54 through the valves 66, which causes the pulleys 52 to move downwards and the full tension of the cables to be restored.

After the load has been dumped out, the lifting-beam is lowered; if a net is involved, the bar to which the net is attached is replaced on the trailer by operating the distributors 64. The hooks are disengaged from the vehicle body or bar and then moved away from the trailer by operating the distributors 64.

The separate controls of the cylinders 54 allow the lifting-beam to be positioned parallel to the edge of the dumping body or net-hook bar even if these are not exactly parallel to the plane of the jib.

Numerous modifications can be made to the invention as described above by substituting equivalent technical arrangements.

In particular, the winch could be replaced by a hydraulic cylinder. The winch could also be driven by an electric motor; in this case the operation of the valves 66 would depend on the amount of current supplied to the winch motor or the power absorbed by the motor. The hydraulic cylinders 54 could be replaced by electric motors supplied with reduced voltage during the unloading operation, so as to maintain the tension of the cables 46 while at the same time allowing the hooks to follow the path imposed on them by the load. The machine could be assembled in a fixed position, with the jib, the tie-rods, the winch, the hydraulic unit and the control desk being fixed to a frame anchored on a concrete foundation. It is understood that all these modifications come within the scope of this invention.

This invention can be particularly applied to machines for unloading trucks or trailers used to transport sugar cane.

What we claim is:

1. A vehicle unloader comprising a sloping jib having an end, a lifting mechanism consisting of a motor, a pulley mounted at the end of the jib, at least one first cable passing over the pulley, a hook to which the first cable is attached, and a hook positioning system consisting of a second cable attached to the hook and to the jib, a cylinder for varying the tension of said second cable, a three-position selector having a first position causing the cylinder to move so that the hook is brought towards the jib, a second position causing the cylinder to move so that the hook is allowed to move in the opposite direction away from the jib and a third position causing the cylinder to be isolated; a power source; and a control unit the operation of which is dependent on the amount of power absorbed by the motor of the lifting mechanism and which connects the cylinder to the power source and ensures that it is supplied with reduced power from said source when the hook is loaded and the motor of the lifting mechanism is energized.

2. The vehicle unloader of claim 1, wherein the hook positioning system further comprises a pump and a discharge tank, said motor is a hydraulic motor having a supply line, said cylinder is a hydraulic cylinder, said three-position selector in its first position connects the cylinder to the pump and in its second position connects the cylinder to the discharge tank, and said control unit comprises a valve which is operated by the pressure in the supply line of the motor and connects the cylinder with a source of low-pressure liquid constituting said power source when the hook is loaded and the motor is energized.

3. The vehicle unloader of claim 2, wherein said valve is mounted in a pipe linking the cyliner to the discharge tank via a pre-loaded check valve and the pump has an exhaust line connected to said pipe between the said valve and check-valve.

4. The vehicle unloader of claim 1, further comprising a lifting beam attached to the cable of the lifting mechanism and having two ends, several of said hooks fixed to the lifting beam, and two identical ones of said hook positioning systems acting on the two ends of the lifting beam.

5. The vehicle unloader of claim 4, wherein the cable of each hook positioning system passes over two of said pulleys mounted on the two ends of the jib, and the two ends of the cable are fixed to the lifting beam so as to form a loop, one of the pulleys being movable by the respective cylinder.

6. The vehicle unloader of claim 4, wherein the lifting mechanism further comprises a motor-driven winch and two cables attached to the two ends of the lifting beam.

7. The vehicle unloader of claim 4, wherein the hooks are fixed to a cross-beam which is hinged to the lifting beam.

* * * * *